US005960856A

United States Patent [19]

Blejde et al.

[11] Patent Number: 5,960,856

[45] Date of Patent: Oct. 5, 1999

[54] STRIP CASTING EMPLOYING NON-CONTACT HEAT ABSORBERS

[75] Inventors: Walter Blejde, Balgownie; Hisahiko Fukase, Wollongong; Rama Ballav Mahapatra, Yarrawarrah, all of Australia

[73] Assignees: Ishikawajima-Harima Heavy Industries Company Limited, Tokyo, Japan; BHP Steel (JLA) Pty. Ltd., Melbourne, Australia

[21] Appl. No.: 08/894,797

[22] PCT Filed: Mar. 6, 1997

[86] PCT No.: PCT/AU97/00133

§ 371 Date: Sep. 10, 1997

§ 102(e) Date: Sep. 10, 1997

[87] PCT Pub. No.: WO97/34718

PCT Pub. Date: Sep. 25, 1997

[30] Foreign Application Priority Data

Mar. 19, 1996 [AU] Australia ..... PN8725

[51] Int. Cl.[6] ..... B22D 11/06; B22D 11/22; B22D 11/124

[52] U.S. Cl. ..... 164/480; 164/417; 164/428; 164/477

[58] Field of Search ..... 164/480, 475, 164/477, 428, 417, 415

[56] References Cited

U.S. PATENT DOCUMENTS 5,584,337 12/1996 Nakashima et al. ..... 164/477
5,720,335 2/1998 Osada et al. ..... 164/480 X
5,762,126 6/1998 Assefpour-Dezfully et al. .. 164/480 X

FOREIGN PATENT DOCUMENTS 0686446 12/1995 European Pat. Off. .
1816868 7/1970 Germany .
1758276 1/1971 Germany .

OTHER PUBLICATIONS

Patent Abstracts of Japan, M–777, p. 131, JP 63–207461 A (Nippon Steel Corp) Aug. 26, 1988.
ASM Handbook, vol. 15 "Casting", 1988, p. 312.

*Primary Examiner*—J. Reed Batten, Jr.
*Attorney, Agent, or Firm*—Kerkam,Stowell, Kondracki & Clarke, P.C.; John C. Kerins

[57] ABSTRACT

A casting pool (30) of ferrous molten metal is supported on a pair of chilled generally horizontal casting rolls (22) forming a nip (27) between them. The casting rolls (22) rotate mutually opposite directions to produce a solidified metal strip (12) moving downwardly from the nip (27). The strip (12) passes along a transit path (10) which takes it away from the nip (27) in an unrestrained loop (29) disposed within a strip enclosure (38) within which the strip is confined through said transit path (10). The strip (12) moves downwardly from the nip (27) to form the unrestrained loop (29) passes between a pair of cooled non-contact heat absorbers (101) to which heat is radiated from the strip (12) whereby to extract from the strip heat generated by completion of solidification of metal therein after leaving the casting pool (30). Heat absorbers (101) are formed as opposite side walls of a cooling collar (100) defining an upper part of enclosure (38) and provided with cooling water ducts (102).

20 Claims, 7 Drawing Sheets

STRIP CASTING EMPLOYING NON-CONTACT HEAT ABSORBERS

TECHNICAL FIELD

This invention relates to continuous casting of metal strip in a strip caster, particularly a twin roll caster.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or damn held in sliding engagement with end surfaces of the rolls so as to dam the two ends of the casting pool against outflow, although alternative means such as electromagnetic barriers have also been proposed.

After leaving the caster the hot strip may be passed to a coiler on which it is wound into a coil. Before proceeding to the coiler it may be subjected to in-line treatment such as controlled temperature reduction, reduction rolling, full heat treatment or a combination of such treatment steps. The coiler and any in-line treatment apparatus generally applies substantial tension to the strip which must be resisted. Moreover, it is necessary to accommodate differences between the casting speed of the twin roll caster and the speed of subsequent in-line processing and coiling. Substantial differences in those speeds may develop particularly during initial start up and until steady state casting speed is achieved. In order to meet these requirements it has been proposed to allow the hot strip leaving the caster to hang unhindered in an unrestrained loop from which is passes through one or more sets of pinch rolls into a tensioned part of the line in which the strip may be subjected to further processing and/or coiling. The pinch rolls provide resistance to the tension generated by the down line equipment and are also intended to feed the strip into the down lying equipment.

Particularly in the casting of steel strip, it is common to enclose the strip leaving the strip caster within a sealed enclosure for scale control purposes. The strip may, for example, be passed through a sealed enclosure charged with an inert atmosphere to inhibit the build up of scale or it may be passed through a sealed enclosure from which oxygen is extracted by oxidation of the strip passing through it in the manner described in our Australian Patent Application No 42235/96.

One particular problem encountered in the direct casting of thin metal strip is that solidification of molten metal in the central part of the strip is generally not completed at the time that the strip leaves the caster. The strip leaving the caster has a central mushy zone which continues to solidify, so giving up heat of solidification which causes reheating of the solidified metal with consequent weakening and thinning of the solidified outer parts of the strip. This effect is particularly severe when casting steel strip in a twin roll caster as the strip leaves the nip at very high temperatures of the order of 1400° C. and there is a substantial central mushy zone which does not solidify until some time after the strip has exited the nip and has lost contact with the chilled casting rolls.

In the case where the strip exiting the nip hangs in an unrestrained loop, the newly formed strip near the nip is required to support a substantial part of the weight of the loop and the weakening of the solidified outer parts of the strip due to reheating caused by continuing solidification of the central mushy zone can be quite sufficient to cause transverse cracking and even complete rupture of the strip in this region. This strip reheating problem is exacerbated by the enclosure of the strip within a sealed enclosure for scale control purposes because there is a build up of heat within the enclosure and the heat of solidification of metal solidifying in the strip after leaving the nip cannot be dissipated by radiation to a cooler surrounding environment. It is not possible to deal with the problem by directing a cooling medium such as water onto the strip within the enclosure since this could get onto the casting roll surfaces and interfere with the stable temperature and heat transfer conditions established between the casting rolls and the casting pool and would also create scaling problems. The present invention provides a simple but effective solution by providing a totally non-contact cooling arrangement.

DISCLOSURE OF THE INVENTION

According to the invention there is provided a method of casting ferrous metal strip comprising supporting a casting pool of ferrous molten metal on a pair of chilled generally horizontal casting rolls forming a nip between them;

rotating the rolls in mutually opposite directions to produce a solidified metal strip moving downwardly from the nip between the casting rolls;

passing the strip along a transit path which takes it away from the nip in an unrestrained loop disposed within a strip enclosure within which the strip is confined through said transit path; and causing the strip moving downwardly from the nip to form the unrestrained to pass between a pair of cooled non-contact heat absorbers to which heat is radiated from the strip whereby to extract from the strip heat generated by completion of solidification of metal therein after leaving the casting pool.

Preferably, the heat absorbers are formed as two plate structures disposed below and one to each side of the nip between the casting rolls so as to face the side faces of the strip passing downwardly from the nip within said loop.

Preferably further the side plates structures are cooled by passage of cooling water through cooling water ducts formed within said plate structures without release of cooling water into said enclosure.

The plate structures may form opposite side walls of an elongate cooling collar forming an upper part of said enclosure so as to encompass the strip passing downwardly from the nip within said unrestrained loop.

The enclosure may be sealed to control ingress of oxygen containing atmosphere whereby to control the formation of scale on the strip as it passes through said transit path. Alternatively, the enclosure may be charged with a non-oxidising gas.

The invention also extends to apparatus for casting ferrous metal strip comprising a pair of generally horizontal casting rolls forming a nip between them;

metal delivery means to deliver ferrous molten metal into the nip between the casting rolls to form a casting pool of molten metal supported on the rolls;

means to chill the casting rolls;

means to rotate the casting rolls in mutually opposite directions whereby to produce a cast strip delivered downwardly from the nip;

a strip enclosure to receive the strip delivered downwardly from the nip;

a strip guide means to guide the strip delivered downwardly from the nip through a transit path within said enclosure which takes it from the nip in an unrestrained loop within the enclosure; and a pair of cooled non-contact heat absorbers disposed below and one to each side of the nip to absorb heat radiated away from the side faces of the strip exiting the nip.

Preferably the heat absorbers extend to at least 0.4 m below the rolls.

BRIEF DESCRIPTION OF THE DRAWINGS

In order that the invention may be more fully explained one particular embodiment will be described in detail with reference to the accompanying drawings in which.

DETAILED DESCRIPTION OF THE PREFERRED EMBODIMENT

Figure 1:
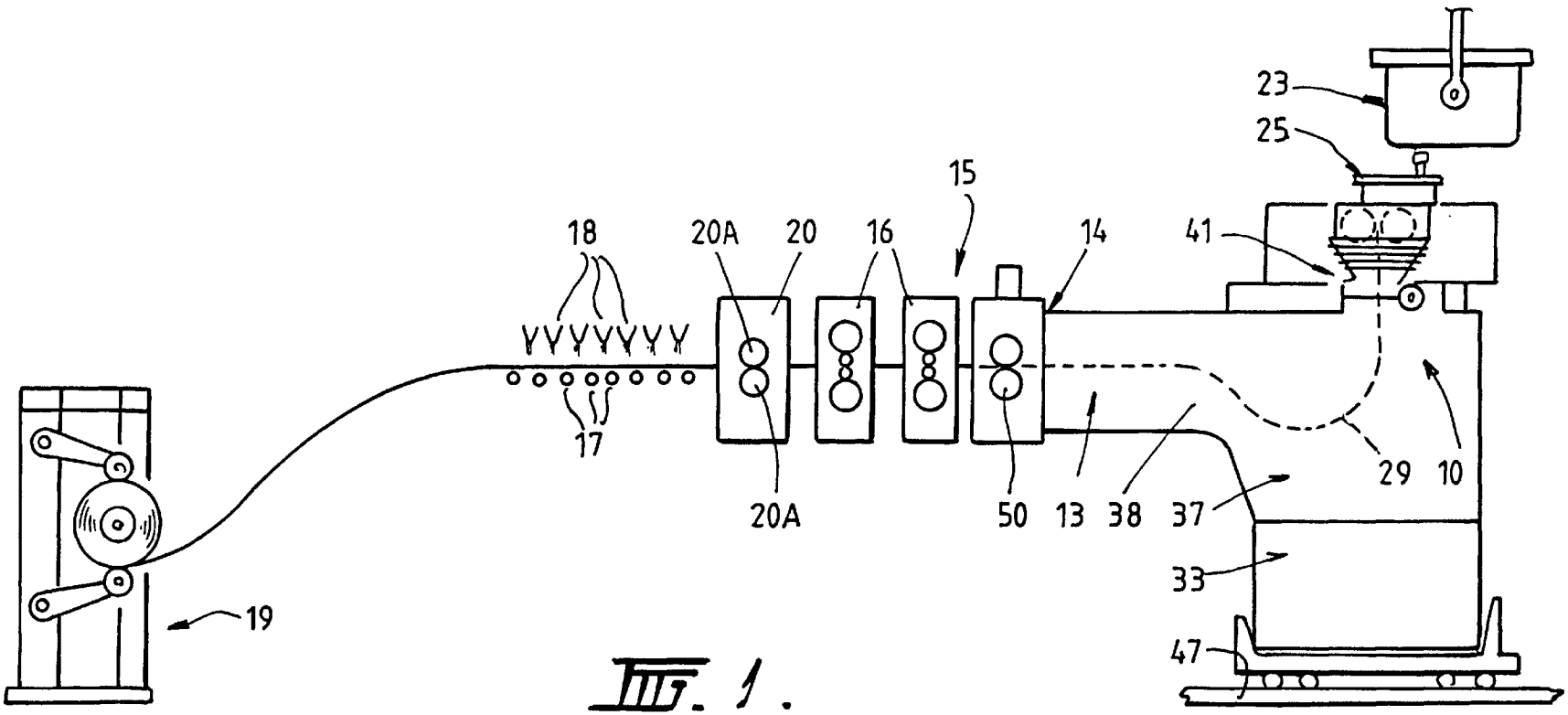
FIG. 1 is a vertical cross-section through a steel strip casting and rolling installation constructed and operated in accordance with the present invention.
Figure 2:
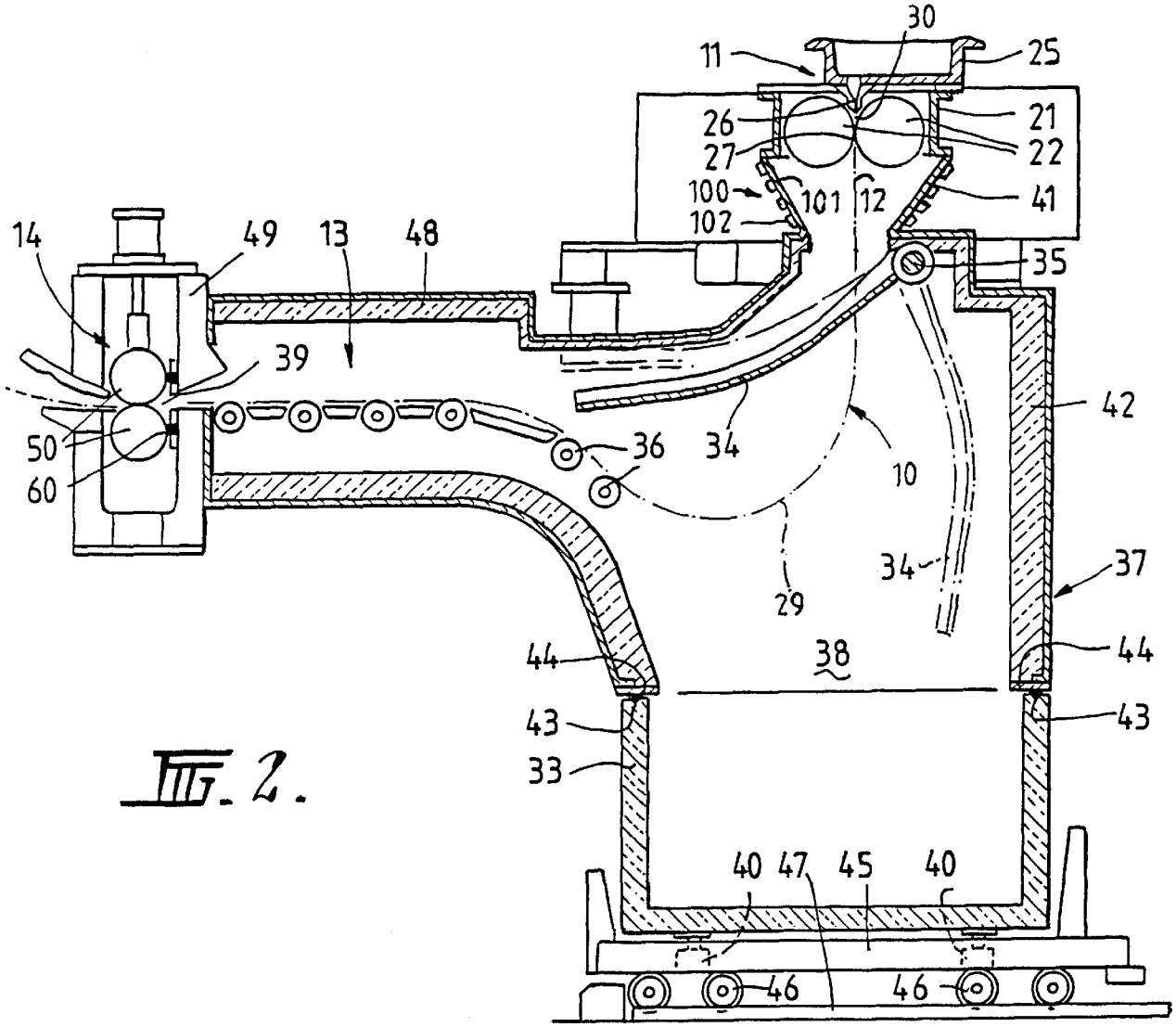
FIG. 2 illustrates essential components of a twin roll caster incorporated in the installation.
Figure 3:
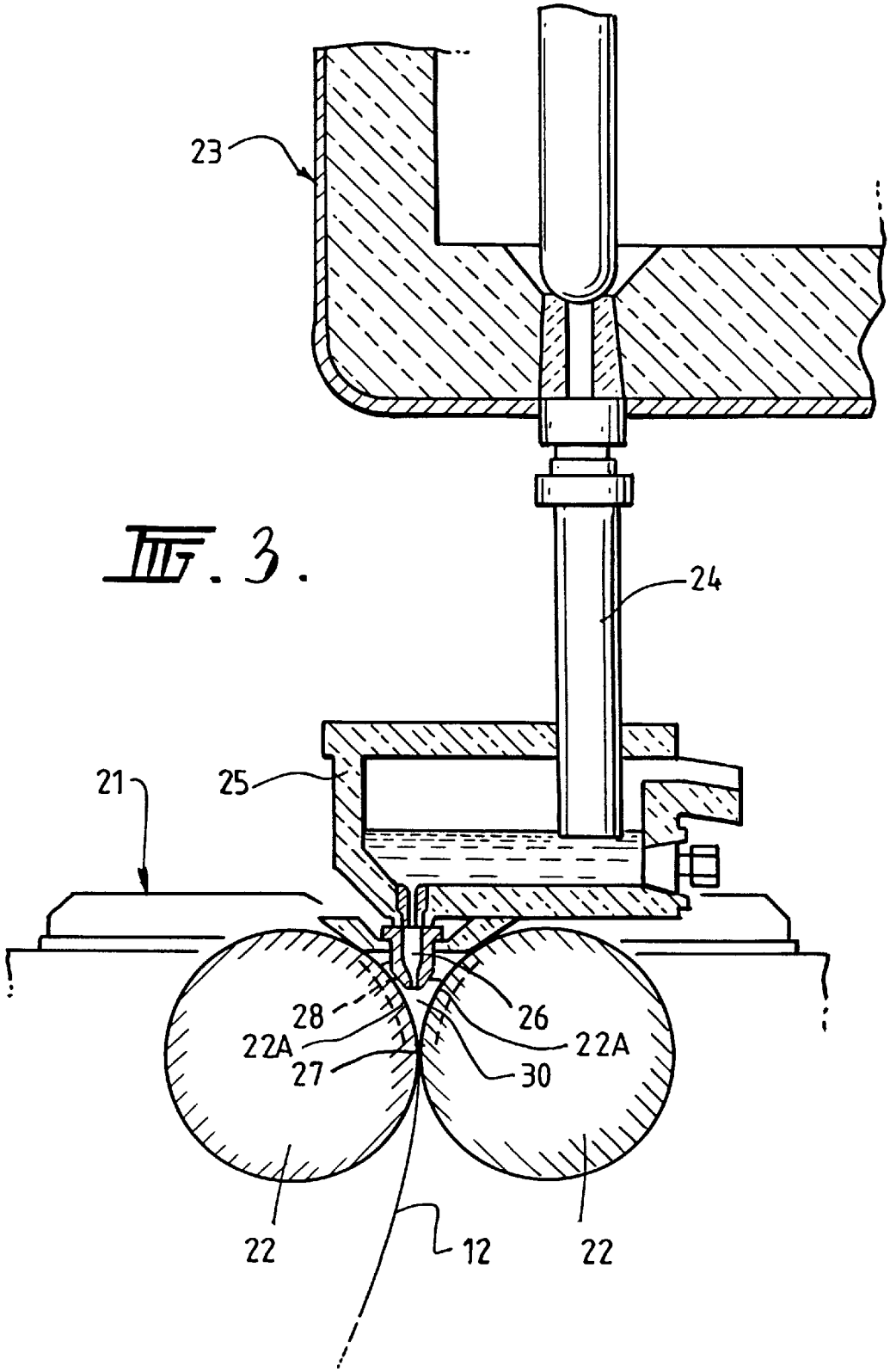
FIG. 3 is a plan view of part of the twin roll caster.
Figure 4:
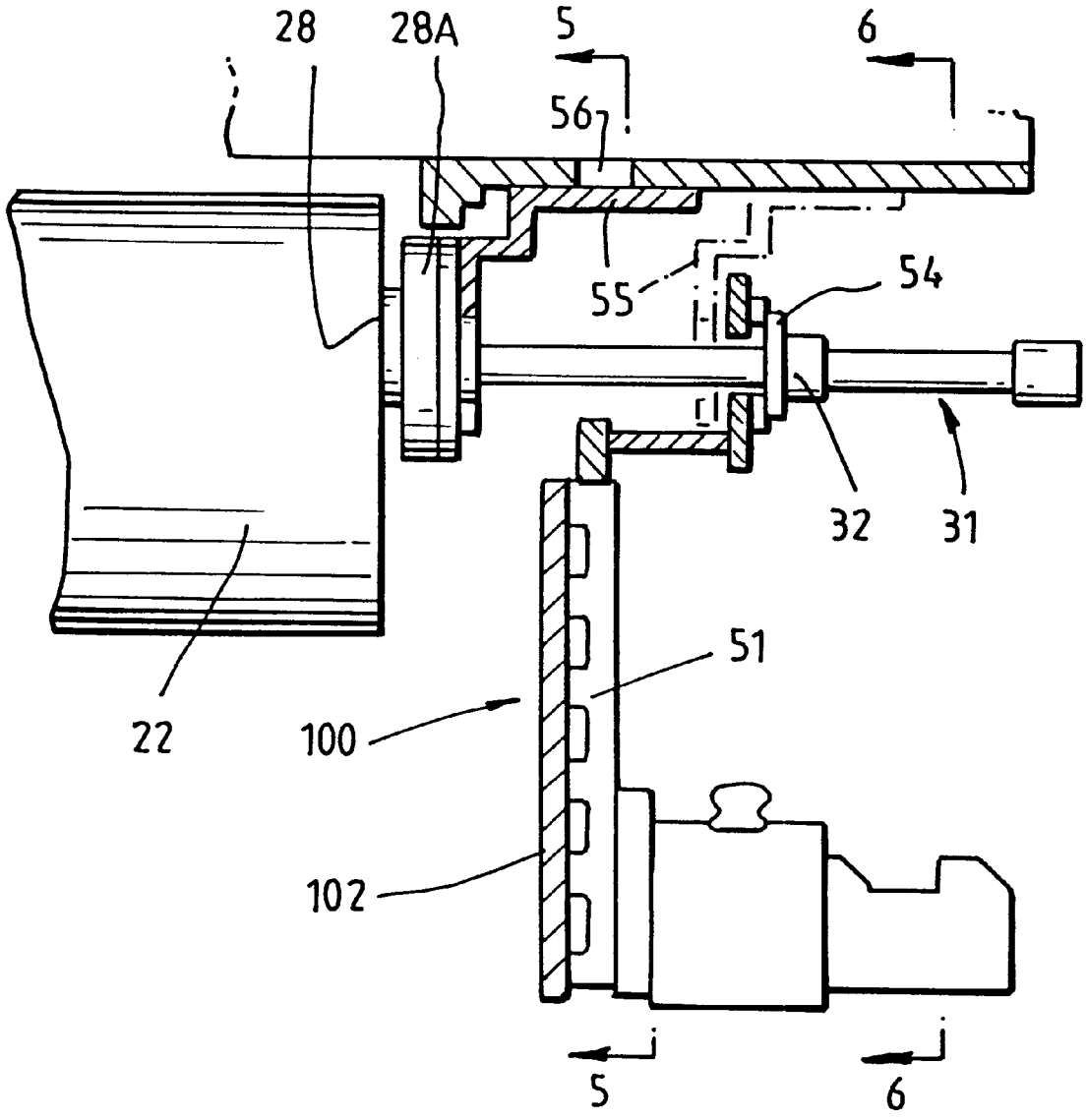
FIG. 4 is an enlarged vertical cross-section through an end part of the twin roll caster.
Figure 5:
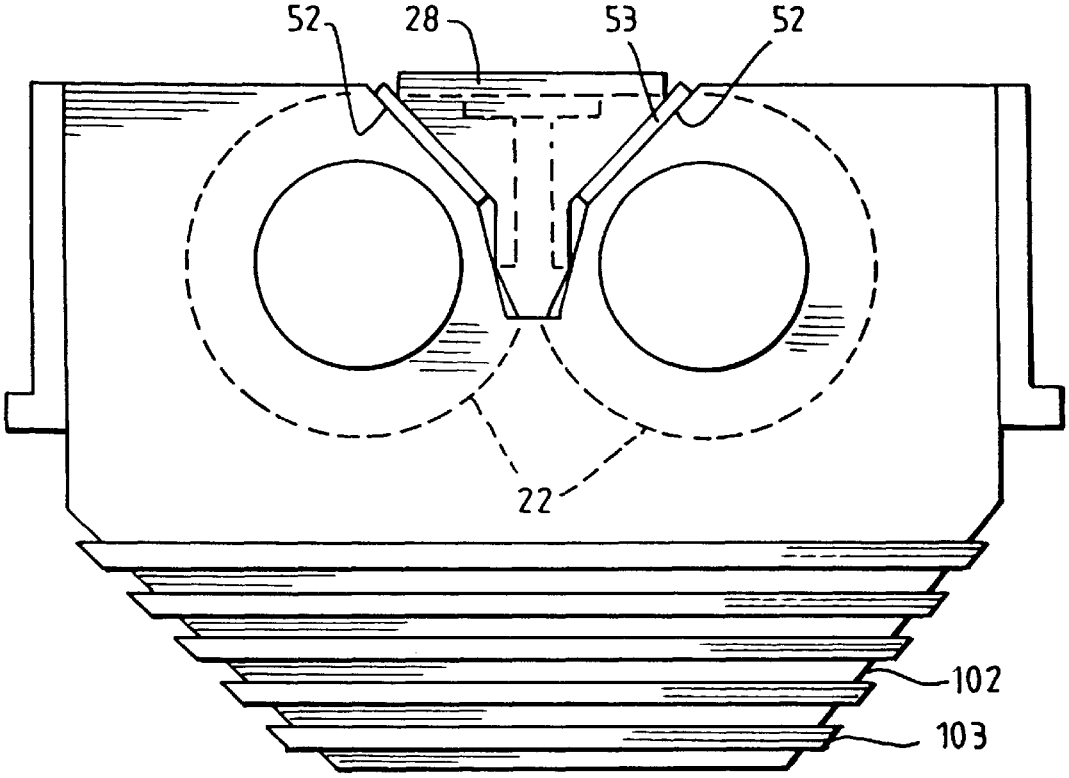
FIG. 5 is a cross-section on the line 5—5 in FIG. 4.
Figure 6:
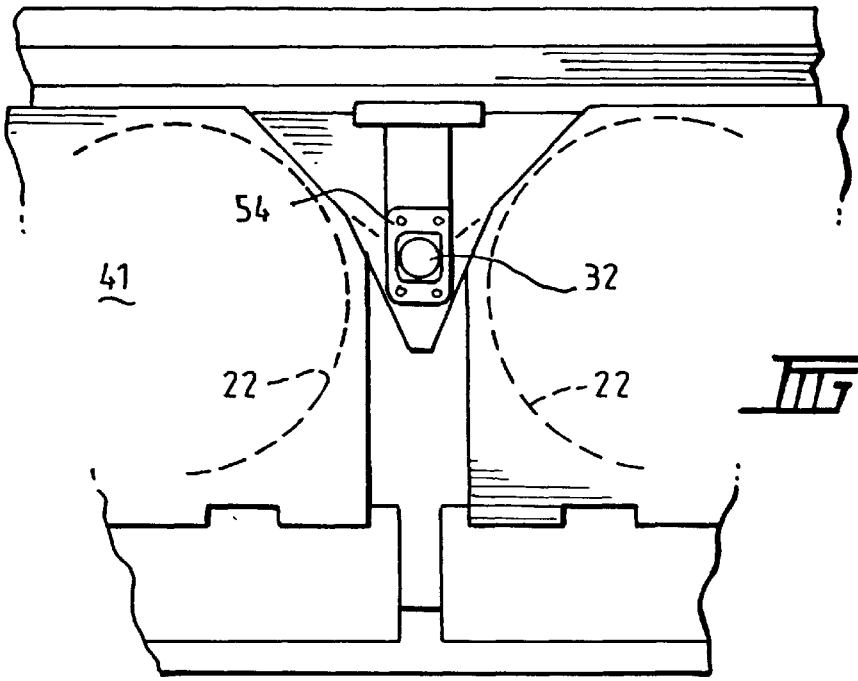
FIG. 6 is a view on the line 6—6 in FIG. 4.
Figure 7:
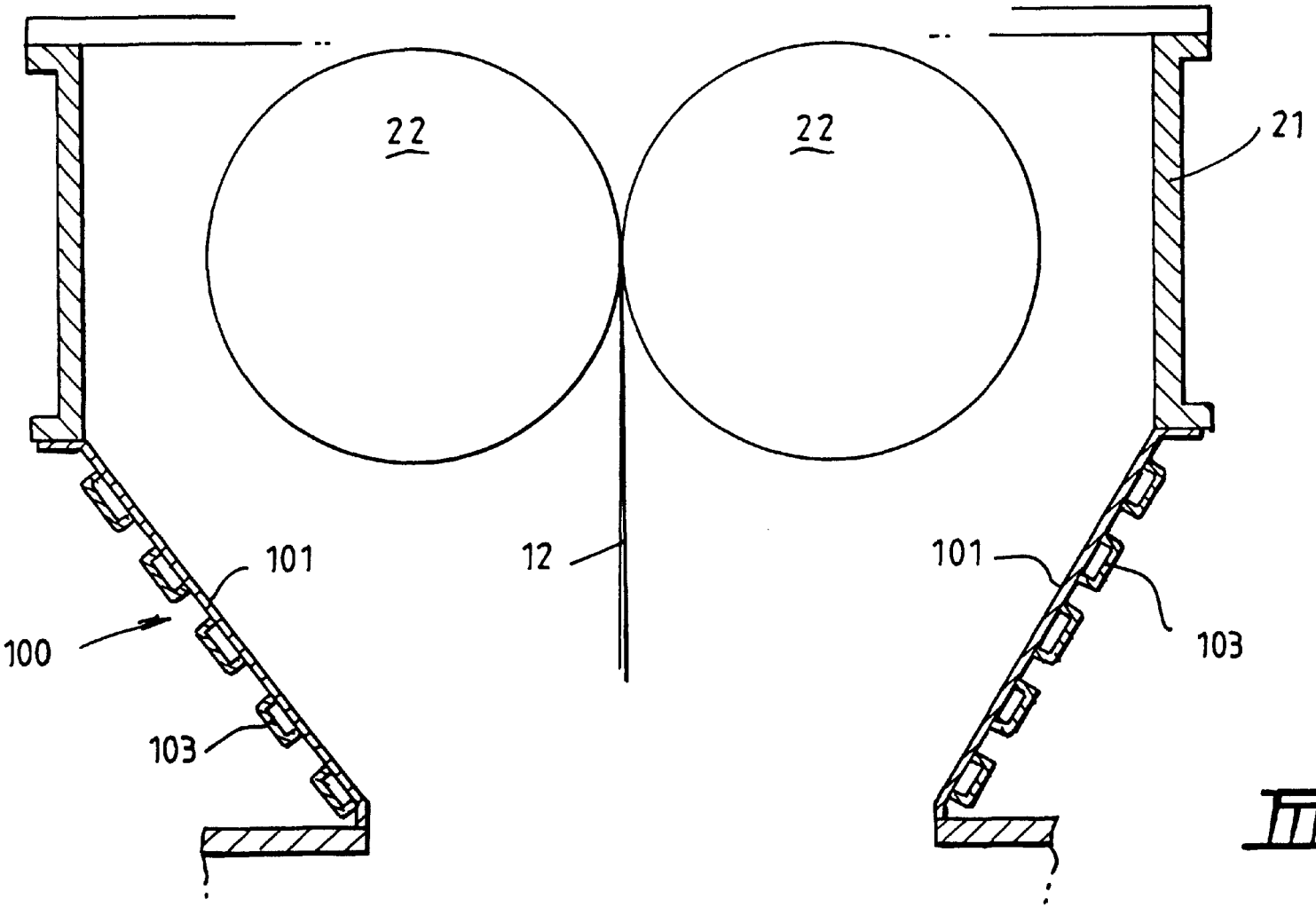
FIG. 7 is an enlargement of part of the apparatus as illustrated in FIG. 2.

The illustrated casting and rolling installation comprises a twin roll caster denoted generally as 11 which produces a cast steel strip 12 which passes in a transit path 10 across a guide table 13 to a pinch roll stand 14. Immediately after exiting the pinch roll stand 14, the strip passes into a hot rolling mill 15 comprising roll stands 16 in which it is hot rolled to reduce its thickness. The thus rolled strip exits the rolling mill through a pinch roll stand 20 comprising a pair of pinch rolls 20A and passes to a run out table 17 on which it may be force cooled by water jets 18 and thence to a coiler 19.

Twin roll caster 11 comprises a main machine frame 21 which supports a pair of parallel casting rolls 22 having casting surfaces 22A. Molten metal is supplied during a casting operation from a ladle 23 through a refractory ladle outlet shroud 24 to a tundish 25 and thence through a metal delivery nozzle 26 into the nip 27 between the casting rolls 22. Hot metal thus delivered to the nip 27 forms a pool 30 above the nip and this pool is confined at the ends of the rolls by a pair of side closure dams or plates 28 which are applied to stepped ends of the rolls by a pair of thrusters 31 comprising hydraulic cylinder units 32 connected to side plate holders 28A. The upper surface of pool 30 (generally referred to as the "meniscus" level) may rise above the lower end of the delivery nozzle so that the lower end of the delivery nozzle is immersed within this pool.

Casting rolls 22 are water cooled so that shells solidify on the moving roller surfaces and are brought together at the nip 27 between them to produce the solidified strip 12 which is delivered downwardly from the nip between the rolls.

At the start of a casting operation a short length of imperfect strip is produced as the casting conditions stabilise. After continuous casting is established, the casting rolls are moved apart slightly and then brought together again to cause this leading end of the strip to break away in the manner described in Australian Patent Application 27036/92 so as to form a clean head end of the following cast strip. The imperfect material drops into a scrap box 33 located beneath caster 11 and at this time a swinging apron 34 which normally hangs downwardly from a pivot 35 to one side of the caster outlet is swung across the caster outlet to guide the clean end of the cast strip onto the guide table 13 which feeds it to the pinch roll stand 14. Apron 34 is then retracted back to its hanging position to allow the strip 12 to hang in an unrestrained loop 29 beneath the caster before it passes to the guide table 13 where it engages a succession of guide rollers 36.

The twin roll caster may be of the kind which is illustrated and described in some detail in granted Australian Patents 631728 and 637548 and U.S. Pat. Nos. 5,184,668 and 5,277,243 and reference may be made to those patents for appropriate constructional details which form no part of the present invention.

For the purpose of controlling the formation of scale on the hot strip in the manner which is disclosed in Australian Patent Application 42235/96, the installation is manufactured and assembled to form a single very large scale enclosure denoted generally as 37 defining a sealed space 38 within which the steel strip 12 is confined throughout a transit path from the nip between the casting rolls to the entry nip 39 of the pinch roll stand 14.

Enclosure 37 is formed by a number of separate wall sections which fit together at various seal connections to form a continuous enclosure wall. These comprise a wall section 41 which is formed at the twin roll caster to enclose the casting rolls and a wall section 42 which extends downwardly beneath wall section 41 to engage the upper edges of scrap box 33 when the scrap box is in its operative position so that the scrap box becomes part of the enclosure. The scrap box and enclosure wall section 42 may be connected by a seal 43 formed by a ceramic fibre rope fitted into a groove in the upper edge of the scrap box and engaging flat sealing gasket 44 fitted to the lower end of wall section 42. Scrap box 33 may be mounted on a carriage 45 fitted with wheels 46 which run on rails 47 whereby the scrap box can be moved after a casting operation to a scrap discharge position. Cylinder units 40 are operable to lift the scrap box from carriage 45 when it is in the operative position so that it is pushed upwardly against the enclosure wall section 42 and compresses the seal 43. After a casting operation the cylinder units 40 are released to lower the scrap box onto carriage 45 to enable it to be moved to scrap discharge position.

Enclosure 37 further comprises a wall section 48 disposed about the guide table 13 and connected to the frame 49 of pinch roll stand 14 which includes a pair of pinch rolls 50 against which the enclosure is sealed by sliding seals 60. Accordingly, the strip exits the enclosure 38 by passing between the pair of pinch rolls 50 and it passes immediately into the hot rolling mill 15. The spacing between pinch rolls 50 and the entry to the rolling mill should be as small as possible and generally of the order of 1 metre or less so as to control the formation of scale prior to entry into the rolling mill.

The enclosure wall section 41 which surrounds the casting rolls is formed with side plates 51 provided with notches 52 shaped to snugly receive the side dam plate holders 28A when the side dam plates 28 are pressed against the ends of the rolls by the cylinder units 32. The interfaces between the side plate holders 28A and the enclosure side wall sections 51 are sealed by sliding seals 53 to maintain sealing of the enclosure. Seals 53 may be formed of ceramic fibre rope.

The cylinder units 32 extend outwardly through the enclosure wall section 41 and at these locations the enclosure is sealed by sealing plates 54 fitted to the cylinder units so as to engage with the enclosure wall section 41 when the cylinder units are actuated to press the side plates against the ends of the rolls. Thrusters 31 also move refractory slides 55 which are moved by the actuation of the cylinder units 32 to close slots 56 in the top of the enclosure through which the side plates are initially inserted into the enclosure and into the holders 28A for application to the rolls. The top of the enclosure is closed by the tundish, the side plate holders 28A and the slides 55 when the cylinder units are actuated to apply the side dam plates against the rolls. In this way the complete enclosure 37 is sealed prior to a casting operation to establish the sealed space 38 whereby to limit the supply of oxygen to the strip 12 as it passes from the casting rolls to the pinch roll stand 14 and so limit the generation of scale on the strip in the manner which is more fully described in Australian Patent Application 42235/96. In an alternative manner of operation, the enclosure 37 could be charged with a non-oxidising gas such as nitrogen in order to control scale formation.

Because the strip hangs in the unrestrained loop 29, the newly formed strip near the nip is required to support a very substantial part of the weight of the loop. Moreover, heat tends to build up rapidly within the enclosure 37 so that the strip in the region is unable to loose heat by radiation and without the provision of a cooling system in accordance with the present invention the strip would develop transverse cracking and may even rupture.

Most of the enclosure wall sections are lined with fire-brick and the scrap box 33 may be lined either with fire-brick or with a castable refractory lining. However, in accordance with the present invention that part of the enclosure wall section 41 which projects downwardly from the casting rolls is formed as an elongate strip cooling collar denoted generally as 100 which is effective to absorb heat from the strip exiting the nip. Collar 100 is formed as a thick steel shell of truncated V cross-section comprising downwardly convergent side walls 101 and trapezoidal end walls 102. The collar is fitted with external water cooling ducts 103 which may be in the form of steel channels welded to the outside faces of the collar walls. Cooling water is passed through ducts 103 to extract heat radiated onto the collar walls by the strip exiting the nip. The cooling water may pass to and from the cooling ducts through suitable inlet and outlet manifolds.

The side walls 101 of collar 100 serve as two water cooled heat absorbers which face the strip exiting the nip heat radiated from the strip onto these absorbers is extracted by the flow of cooling water and is thereby effectively taken from the strip. According the heat of solidification of molten steel solidifying in the strip after exiting the nip is removed from the strip and its temperature therefore decreases.

Figure 8:
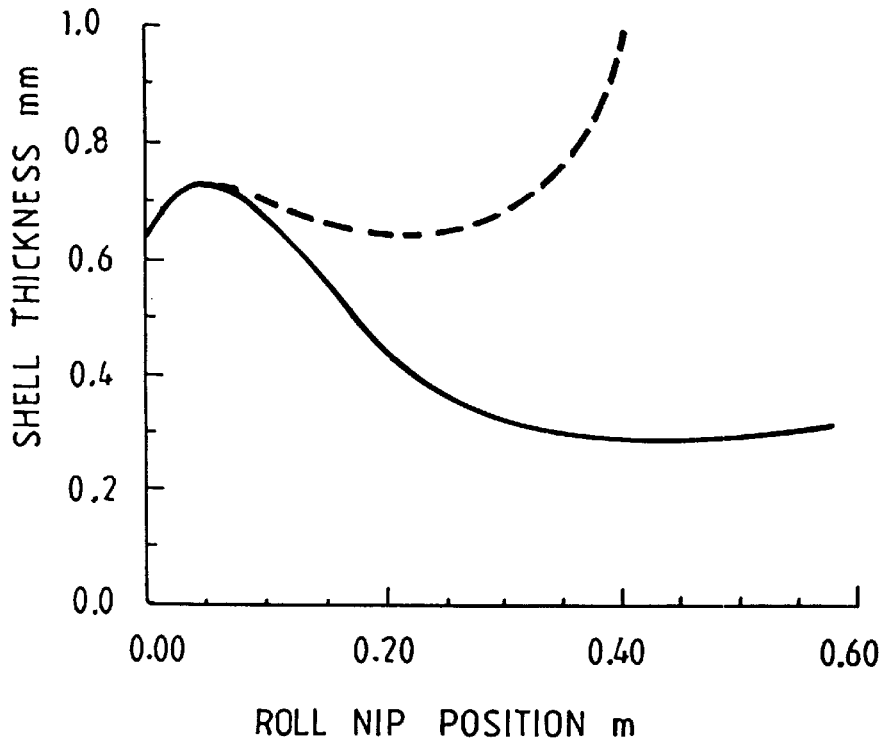
FIG. 8 plots typical solidified shell thickness values in a twin roll caster before and after provision of a cooling collar in accordance with the present invention.
Figure 9:
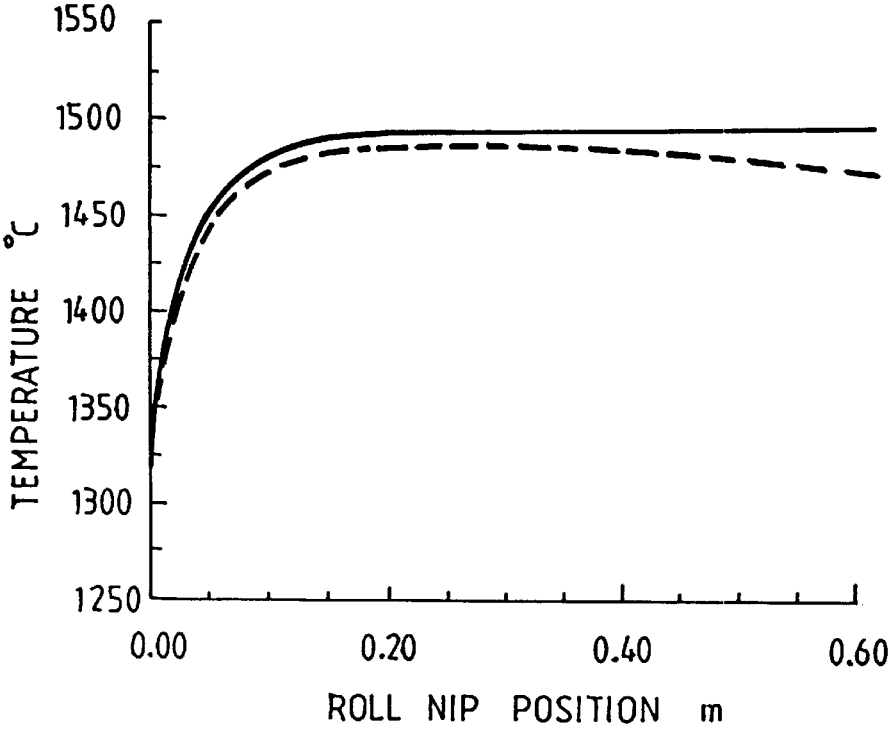
FIG. 9 illustrates the effect of the cooling collar on the strip temperature at locations immediately below the nip between the cooling rolls.

FIGS. 8 and 9 illustrate typical shell thickness and strip surface temperatures obtained during casting of steel strip in a twin roll caster generally as illustrated but both with and without the provision of a cooling collar at the nip exit. The solid line in FIG. 8 illustrates the typical thinning of the strip observed when there is no cooling collar at the nip exit whereas the broken line illustrates the manner in which the solidified shells continue to thicken after the strip leaves the nip when the cooling collar is in operation. The solid line in FIG. 9 illustrates the surface temperature of the strip at locations beneath the nip when the cooling collar is not in operation showing that the strip remains at a substantially constant elevated temperature for a considerable distance beneath the nip. The dotted line shows the effect of operation of the cooling collar whereby the strip surface temperature does not reach the same peak temperature and begins to decrease steadily soon after the strip leaves the nip.

In a typical twin roll caster casting steel strip the temperature of the strip passing from the caster will be of the order 1400° C. and the temperature of the strip presented to the mill will be about 1200° C. The strip may have a width in the range 0.9 m to 1.8 m and a thickness in the range 1.0 mm to 2.0 mm. This strip speed may be of the order of 1.0 m/s. Under these conditions the heat extracted at the cooling collar may be of the order of 250 kWatts/$m^2$, requiring a flow of cooling water of the order of 35 $m^2$/hr and a temperature differential of the order of 6° C. through the collar.

We claim:

1. A method of casting ferrous metal strip comprising supporting a casting pool (30) of ferrous molten metal on a pair of chilled generally horizontal casting rolls (22) forming a nip (27) between them; rotating the rolls (22) in mutually opposite directions to produce a solidified metal strip (12) moving downwardly from the nip (27) between the casting rolls (22); and passing the strip (12) along a transit path (10) which takes it away from the nip (27) in an unrestrained loop (29) disposed within a strip enclosure (38) within which the strip is confined through said transit path; characterised by causing the strip (12) moving downwardly from the nip (27) to form the unrestrained loop (29) to pass between a pair of cooled non-contact heat absorbers (101) to which heat is radiated from the strip (12) whereby to extract from the strip heat generated by completion of solidification of metal therein after leaving the casting pool (30).

2. A method as claimed in claim 1, further characterised in that the heat absorbers (101) are formed as two plate structures disposed below and one to each side of the nip (27) between the casting rolls (22) so as to face the side faces of the strip (12) passing downwardly from the nip (27) within said loop (29).

3. A method as claimed in claim 2, further characterised in that the side plate structures are cooled by passage of cooling water through cooling water ducts (103) formed within said plate structures without release of cooling water into said enclosure (38).

4. A method as claimed in claim 2 or further characterised in that the plate structures form opposite side walls of an elongate cooling collar (100) forming an upper part of said enclosure (38) so as to encompass the strip (12) passing downwardly from the nip (27) within said unrestrained loop (29).

5. A method as claimed in claim 1, further characterised in that said enclosure (38) is sealed to control ingress of oxygen containing atmosphere whereby to control the formation of scale on the strip (12) as it passes through said transit path (10).

6. A method as claimed in claim 5, further characterised in that the enclosure is charged with a non-oxidising gas.

7. A method as claimed in claim 3, wherein the plate structures form opposite side walls of an elongate cooling collar forming an upper part of said enclosure so as to encompass the strip passing downwardly from the nip within said unrestrained loop.

8. A method as claimed in claim 2, wherein said enclosure is sealed to control ingress of oxygen containing atmosphere whereby to control the formation of scale on the strip as it passes through said transit path.

9. Apparatus for casting ferrous metal strip comprising a pair of generally horizontal casting rolls (22) forming a nip (27) between them; metal delivery means (23, 24, 25, 26) to deliver ferrous molten metal into the nip (27) between the casting rolls (22) to form a casting pool (30) of molten metal supported on the rolls (22); means to chill the casting rolls (22); means to rotate the casting rolls (22) in mutually opposite directions whereby to produce a cast strip delivered downwardly from the nip; a strip enclosure (38) to receive the strip (12) delivered downwardly from the nip (27); and a strip guide means (13) to guide the strip delivered downwardly from the nip (27) through a transit path (10) within said enclosure (38) which takes it from the nip (27) in an unrestrained loop (29) within the enclosure (38); characterised in that a pair of cooled non-contact heat absorbers (101) are disposed below and one to each side of the nip (27) to absorb heat radiated away from the side faces of the strip (12) exiting the nip (27).

10. Apparatus as claimed in claim 9, further characterised in that the heat absorbers (101) extend to at least 0.4 m below the rolls.

11. Apparatus as claimed in claim 9, further characterised in that the heat absorbers (101) are formed as two plate structures disposed below and one to each side of the nip (27) between the casting rolls (22) so as to face the side faces of the strip (12) exiting the nip (27).

12. Apparatus as claimed in claim 11, further characterised in that the side plate structures are formed with cooling water ducts (103) for passage of cooling water through the ducts to force cool said heat absorbers (101) without release of cooling water into the enclosure (38).

13. Apparatus as claimed in claim 11, further characterised in that the plate structures form opposite side walls of an elongate cooling collar (100) defining an upper part of said strip enclosure (38) and encompassing a space immediately below the nip (27) between the casting rolls (22) so that strip exiting the nip must pass through the cooling collar (100).

14. Apparatus as claimed in claim 9, comprising enclosure sealing means to restrict ingress of egress of gas to or from said enclosure (38).

15. Apparatus as claimed in claim 10, wherein the heat absorbers are formed as two plate structures disposed below and one to each side of the nip between the casting rolls so as to face the side faces of the strip exiting the nip.

16. Apparatus as claimed in claim 15, wherein the side plate structures are formed with cooling water ducts for passage of cooling water through the ducts to force cool said heat absorbers without release of cooling water into the enclosure.

17. Apparatus as claimed in claim 12, wherein the plate structures form opposite side walls of an elongate cooling collar defining an upper part of said strip enclosure and encompassing a space immediately below the nip between the casting rolls so that strip exiting the nip must pass through the cooling collar.

18. Apparatus as claimed in claim 10, comprising enclosure sealing means to restrict ingress of egress of gas to or from said enclosure.

19. Apparatus as claim in claim 7, comprising enclosure sealing means to restrict ingress of egress of gas to or from said enclosure.

20. Apparatus as claim in claim 12, comprising enclosure sealing means to restrict ingress of egress of gas to or from said enclosure.

* * * * *